US007171932B2

(12) United States Patent
Vattaneo et al.

(10) Patent No.: US 7,171,932 B2
(45) Date of Patent: Feb. 6, 2007

(54) INTERNAL-COMBUSTION ENGINE HAVING AN ELECTRONICALLY CONTROLLED HYDRAULIC DEVICE FOR VARIABLY ACTUATING INTAKE VALVES

(75) Inventors: Francesco Vattaneo, Pancallieri (IT); Gianluca Canino, Turin (IT); Luca Iannarelli, Settimo Torinese (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 13 days.

(21) Appl. No.: 11/190,325

(22) Filed: Jul. 27, 2005

(65) Prior Publication Data

US 2006/0090718 A1 May 4, 2006

(30) Foreign Application Priority Data

Oct. 28, 2004 (EP) ..... 04425809

(51) Int. Cl.
*F01L 1/02* (2006.01)

(52) U.S. Cl. ..... 123/90.31; 123/90.16; 123/90.15

(58) Field of Classification Search ..... 123/90.15, 123/90.16, 90.12, 90.31
See application file for complete search history.

(56) References Cited

U.S. PATENT DOCUMENTS 4,394,854 A * 7/1983 Huber ..... 123/198 F
6,227,154 B1 5/2001 Wakeman ..... 123/90.16
2003/0154938 A1 8/2003 Vattaneo et al. ..... 123/90.11

FOREIGN PATENT DOCUMENTS

DE 3611476 A1 4/1987
EP 0 803 642 B1 10/1997
EP 1 243 761 A1 3/2002

OTHER PUBLICATIONS

U.S. Appl. No. 11/209,958, filed Aug. 23, 2005, Pecori et al.

* cited by examiner

*Primary Examiner*—Thomas Denion
*Assistant Examiner*—Zelalem Eshete
(74) *Attorney, Agent, or Firm*—Heslin Rothenberg Farley & Mesiti P.C.; Victor A. Cardona

(57) ABSTRACT

An internal-combustion engine has a cylinder head, in which two shafts are mounted rotating. A first shaft is a camshaft, equipped both with cams that control the intake valves by means of an electronically controlled hydraulic device and with cams that control the exhaust valves mechanically. The second shaft is without cams and has an end coming out of the engine and constituting a power take-off for control of auxiliary service devices. The engine can be obtained with simple operations starting from an engine of a conventional type.

7 Claims, 5 Drawing Sheets

INTERNAL-COMBUSTION ENGINE HAVING AN ELECTRONICALLY CONTROLLED HYDRAULIC DEVICE FOR VARIABLY ACTUATING INTAKE VALVES

CROSS REFERENCE TO RELATED APPLICATIONS

This application is a claims priority from European patent application No. 04425809.3, filed on 28 Oct. 2004, the entire disclosure of which is incorporated herein by reference.

BACKGROUND OF THE INVENTION

The present invention relates to multicylinder internal-combustion engines of the type comprising an engine block, defining a plurality of cylinders, an engine shaft, and a cylinder head, as well as a pair of shafts mounted rotating in the cylinder head and controlled in rotation by the engine shaft via transmission means.

In conventional engines of the type specified above, both of the shafts that are mounted rotating in the cylinder head are camshafts designed to control, respectively, the intake valves and the exhaust valves associated to the various cylinders of the engine.

SUMMARY OF THE INVENTION

The problem that underlies the present invention is to apply to an engine of the type specified above a system for variable actuation of the intake valves which uses an electronically controlled hydraulic device for control of the intake valves.

The present applicant has for some time now undertaken studies and conducted experiments in the field of electronically controlled hydraulic devices for variable actuation of the valves of an engine. The present applicant is holder of a wide range of patents and has filed numerous patent applications regarding engines equipped with systems for variable actuation of the valves, of the type referred to above. For immediate reference, FIG. 1 of the annexed drawings shows a cross-sectional view of an engine according to the art, of the type described in the European patent No. EP 0 803 642 B1 filed in the name of the present applicant.

With reference to said figure, the engine illustrated therein is a multicylinder engine, for example, an engine with four cylinders set in line, comprising a cylinder head 1.

The cylinder head 1 comprises, for each cylinder, a cavity 2 formed by the base surface 3 of the head 1, defining the combustion chamber, into which there give out two intake pipes 4, 5 and two exhaust pipes 6. Communication of the two intake pipes 4, 5 with the combustion chamber 2 is controlled by two intake valves 7, of the traditional poppet or mushroom type, each comprising a stem 8 mounted so that it slides in the body of the head 1. Each valve 7 is recalled towards the closing position by springs 9, set between an internal surface of the head 1 and an end cup or bucket 10 of the valve. Communication of the two exhaust pipes 6 with the combustion chamber is controlled by two valves 70, which are also of a traditional type and associated to which are springs 9 for return thereof towards the closed position. The opening of each intake valve 7 is controlled, in the way that will be described in what follows, by a camshaft 11, which is mounted rotating about an axis 12 within supports of the cylinder head 1 and comprises a plurality of cams 14 for actuation of the intake valves 7.

Each cam 14 controlling an intake valve 7 co-operates with the cap 15 of a tappet 16, mounted so that it can slide along an axis 17, which in the case of the example illustrated in the prior document referred to previously, is directed substantially at 90° with respect to the axis of the valve 7. The cap 15 is recalled against the cam 14 by a spring associated thereto. The tappet 16 constitutes a pumping piston mounted so that it slides within a bushing 18 carried by a body 19 of a pre-assembly 20, incorporating all the electrical and hydraulic devices associated to actuation of the intake valves, according to what is described in detail in what follows. The pumping piston 16 is able to transmit a thrust to the stem 8 of the valve 7 so as to bring about opening of the latter against the action of the elastic means 9 by means of fluid under pressure (preferably oil coming from the lubrication circuit of the engine) present in a pressure chamber C which the pumping piston 16 faces, and by means of a piston 21 mounted so that it can slide in a cylinder body formed by a bushing 22, which is also carried by the body 19 of the subassembly 20. Once again in the known solution illustrated in FIG. 1, the pressurized-fluid chamber C associated to each intake valve 7 can be set in communication with an exhaust port 23 via a solenoid valve 24. The solenoid valve 24, which can be of any known type suited to the function illustrated herein, is controlled by electronic control means, designated schematically by 25, according to signals S indicating parameters of operation of the engine, such as the position of the accelerator and the number of revs of the engine. When the solenoid valve 24 is open, the chamber C enters into communication with the port 23, so that the fluid under pressure present in the chamber C flows in said port and there is obtained a decoupling of the cam 14 and of the respective tappet 16 from the intake valve 7, which then returns rapidly into its closing position under the action of the return springs 9. By controlling communication between the chamber C and the exhaust port 23, it is consequently possible to vary, as desired, the opening time and opening stroke of each intake valve 7.

The exhaust ports 23 of the various solenoid valves 24 all give out into one and the same longitudinal port 26 communicating with pressure accumulators 27, only one of which is visible in FIG. 1.

All the tappets 16 with the associated bushings 18, the pistons 21 with the associated bushings 22, the solenoid valves 24 and the corresponding ports 23, 26, are carried by and made out of the aforesaid body 19 of the pre-assembly 20, to the advantage of speed and ease of assembly of the engine.

The exhaust valves 70 associated to each cylinder are controlled, in the embodiment illustrated in FIG. 1, in a traditional way, by a respective camshaft 28, via respective tappets 29, even though in principle there is not is excluded, in the case of the prior document referred to previously, an application of the hydraulic-actuation system also to the control of the exhaust valves.

Once again with reference to FIG. 1, the variable-volume chamber defined within the bushing 22 and facing the piston 21 (which in FIG. 1 is illustrated in its condition of minimum volume, since the piston 21 is in its top dead-centre position) communicates with the pressurized-fluid chamber C via an opening 30 made in an end wall of the bushing 22. Said opening 30 is engaged by an end nose 31 of the piston 21 in such a way as to provide hydraulic braking of the movement the valve 7 during closing thereof, when the valve assumes the closing position, in so far as the oil present in the variable-volume chamber is forced to flow into the pressurized-fluid chamber C, passing through the play existing between the end nose 31 and the wall of the opening 30 engaged thereby. In addition to the communication formed by the opening 30, the pressurized-fluid chamber C and the variable-volume chamber of the piston 21 communicate with one another via internal passages made in the body of the piston 21 and controlled by a non-return valve 32, which enables passage of fluid only from the pressurized chamber C to the variable-volume chamber of the piston 21.

During normal operation of the known engine illustrated in FIG. 1, when the solenoid valve 24 shuts off communication between the pressurized-fluid chamber C and the exhaust port 23, the oil present in said chamber transmits the movement of the pumping piston 16, imparted by the cam 14, to the piston 21 that controls opening of the valve 7. In the initial step of the movement of opening of the valve, the fluid coming from the chamber C reaches the variable-volume chamber of the piston 21, passing through the non-return valve 32 and through further passages that set the internal cavity of the piston 21, which has a tubular conformation, in communication with the variable-volume chamber. After a first displacement of the piston 21, the nose 31 comes out from the opening 30 so that the fluid leaving the chamber C can pass directly into the variable-volume chamber through the opening 30, which is now free.

In the reverse movement of closing of the valve, as already said, during the final step the nose 31 enters the opening 30, causing hydraulic braking of the valve so as to prevent any impact of the body of the valve against its seat, for example, following upon opening of the solenoid valve 24, which causes immediate return of the valve 7 into the closing position.

As an alternative to the hydraulic-braking device illustrated in FIG. 1, the present applicant has also already proposed (see the European patent application No. EP 1 344 900 A2) an alternative solution, in which the piston 21 controlling the intake valve of the engine is without the nose end, and the non-return valve 32, instead of being made in the body of the piston 21, is made in a fixed part. Furthermore, in the wall of the bushing, within which there is slidably mounted the piston 21 there give out one or more passages communicating directly with the pressure chamber C. Said passages are shaped and positioned so that they are intercepted progressively by the piston 21 in the final step of closing of the valve of the engine, for the purpose of providing a restriction of the cross section of passage of the fluid, with a consequent hydraulic-braking effect. In the solution proposed in the European patent application No. EP 1 344 900 A2, moreover, between the piston 21 controlling the valve of the engine and the stem of the valve of the engine there are set an auxiliary hydraulic tappet.

The purpose of the present invention is to provide an engine of the type indicated at the start of the present description, which will exploit an electronically controlled hydraulic device for variable actuation of the intake valves of the engine and which may be obtained in a relatively simple way, starting from a conventional engine with two camshafts in the cylinder head.

In order to achieve said purpose, the subject of the present invention is an internal-combustion engine comprising an engine block defining a plurality of cylinders, an engine shaft, and a cylinder head, as well as a pair of shafts mounted rotating in the cylinder head and controlled in rotation by the engine shaft via transmission means, said internal-combustion engine being characterized in that one of said shafts mounted rotating in the cylinder head is a camshaft, comprising both cams for control of the intake valves of the engine and cams for control of the exhaust valves of the engine, in that the cams controlling the intake valves of the engine control said valves by means of an electronically controlled hydraulic device for variable actuation of the valves, in that the cams controlling the exhaust valves control said valves mechanically, and in that the second of the two shafts mounted rotating in the cylinder head is without cams and has one end coming out of the cylinder head and constituting a power take-off.

BRIEF DESCRIPTION OF THE DRAWINGS

The present invention will now be described with reference to the annexed plate of drawings, which are provided purely by way of non-limiting example and in which.

DETAILED DESCRIPTION OF THE INVENTION

Figure 1:
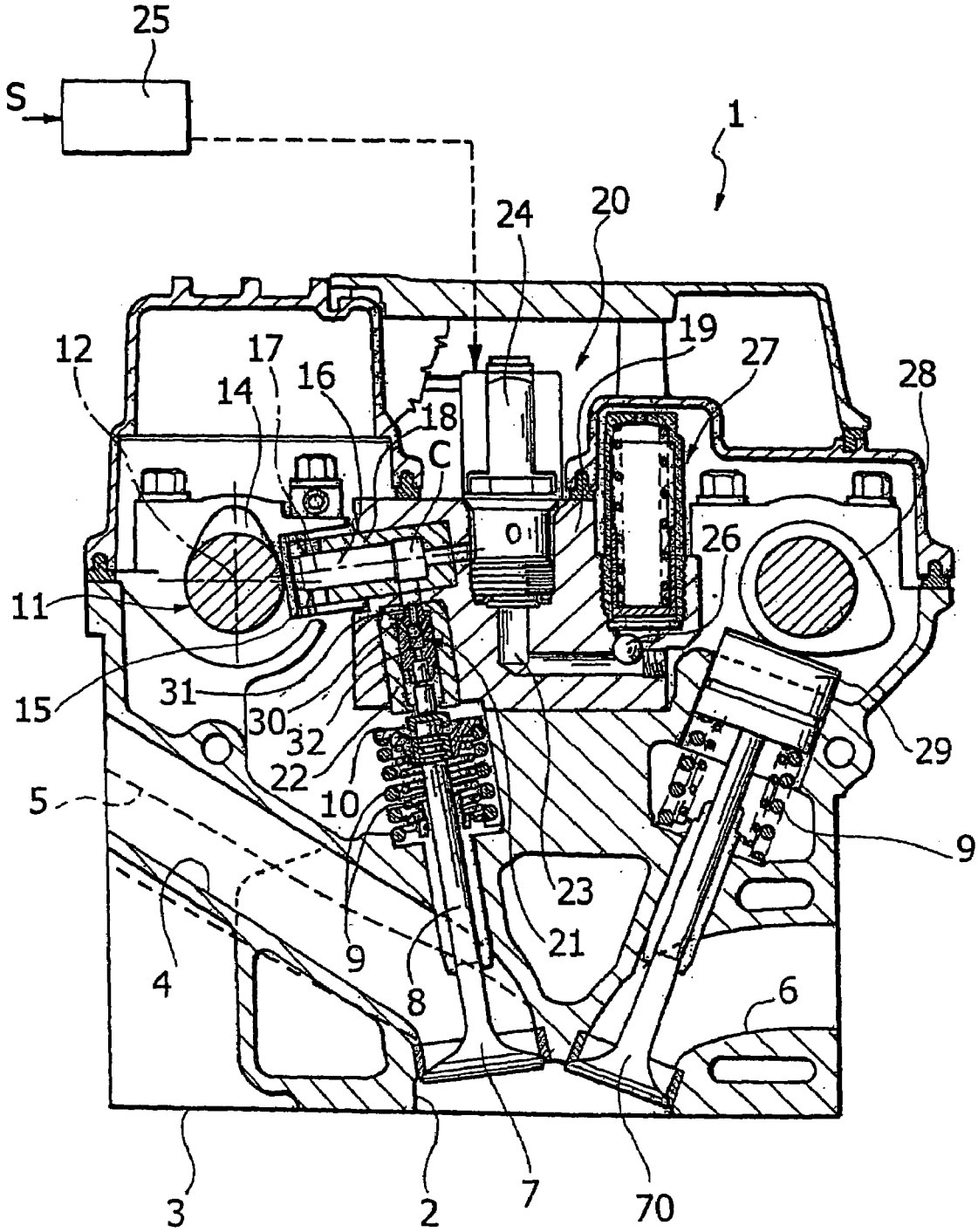
FIG. 1 is a cross-sectional view of an engine according to the known art, already described above.
Figure 2:
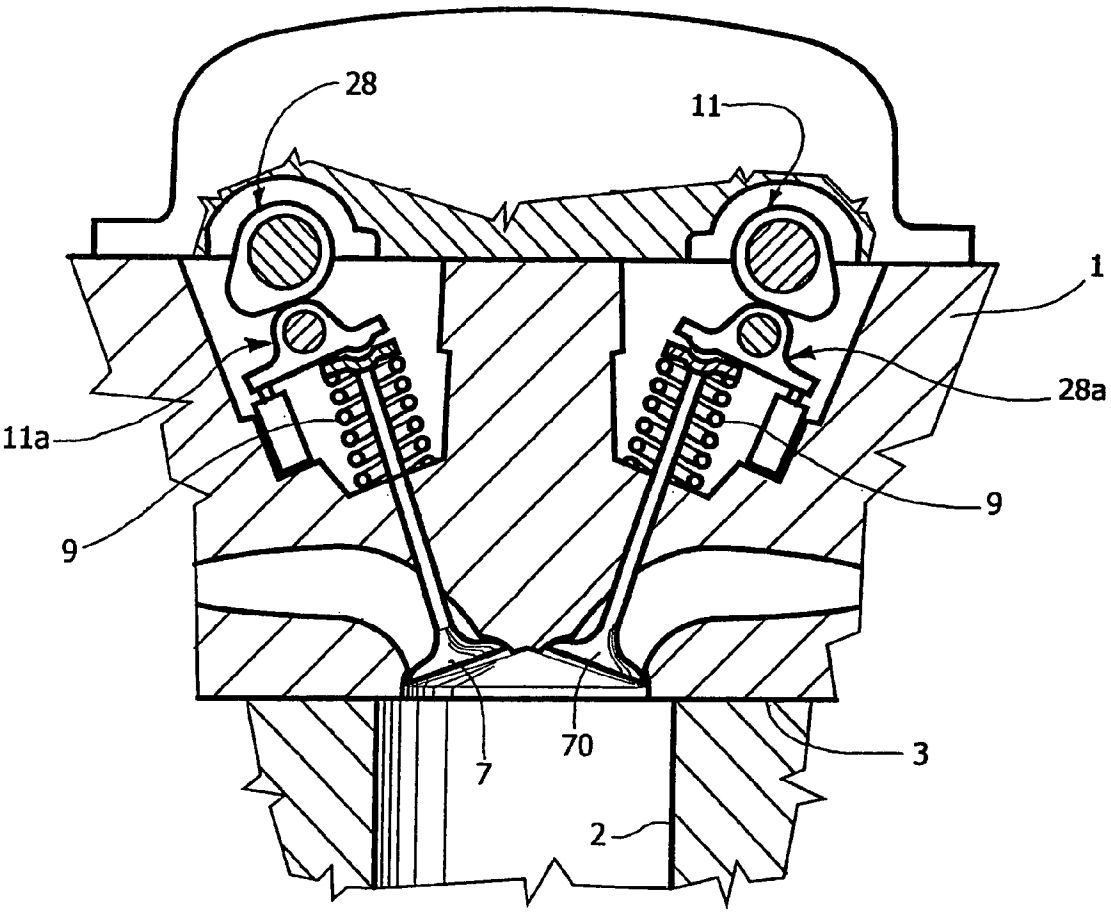
FIG. 2 is a cross-sectional view of a conventional engine without a system for variable actuation of the valves, having a cylinder head with two camshafts for control of the intake valves and of the exhaust valves, respectively.

FIG. 2 of the annexed plate of drawings shows the cross section of the cylinder head of an internal-combustion engine of a conventional type that can be converted with relative ease into an engine equipped with a system for variable actuation of the intake valves, exploiting the teachings of the present invention. In FIG. 2, parts in common with those of FIG. 1 are designated by the same reference numbers, but the notation of the shafts 11, 28 has been reversed, for reasons that will emerge clearly from what follows. As may be seen, the conventional engine illustrated in the figure envisages two camshafts 11, 28, which control the intake valves 7 and exhaust valves 70 mechanically by means of rockers 11*a*, 28*a*, respectively.

Figure 3:
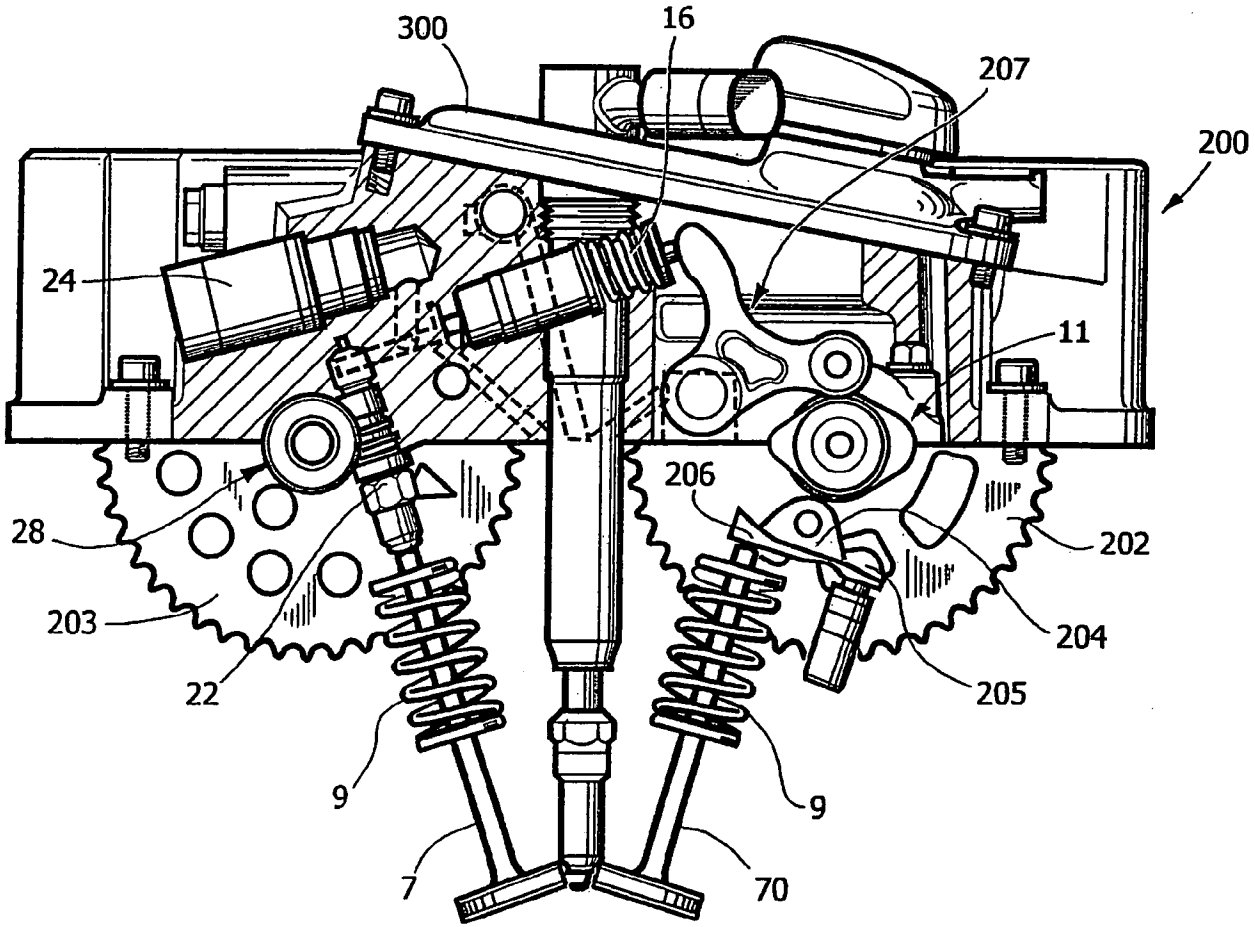
FIG. 3 is a schematic view of the components that are to be applied to the conventional engine of FIG. 2 to convert it into an engine according to the invention, with a cylinder head having a single camshaft, an auxiliary shaft without cams, and an electronically controlled hydraulic system for variable actuation of the intake valves.

FIG. 3 shows the assembly that can be mounted on the cylinder head of the conventional engine of FIG. 2 instead of the corresponding parts illustrated therein for converting the conventional engine into an engine equipped with an electronically controlled hydraulic device for actuation the intake valves.

Figure 4:
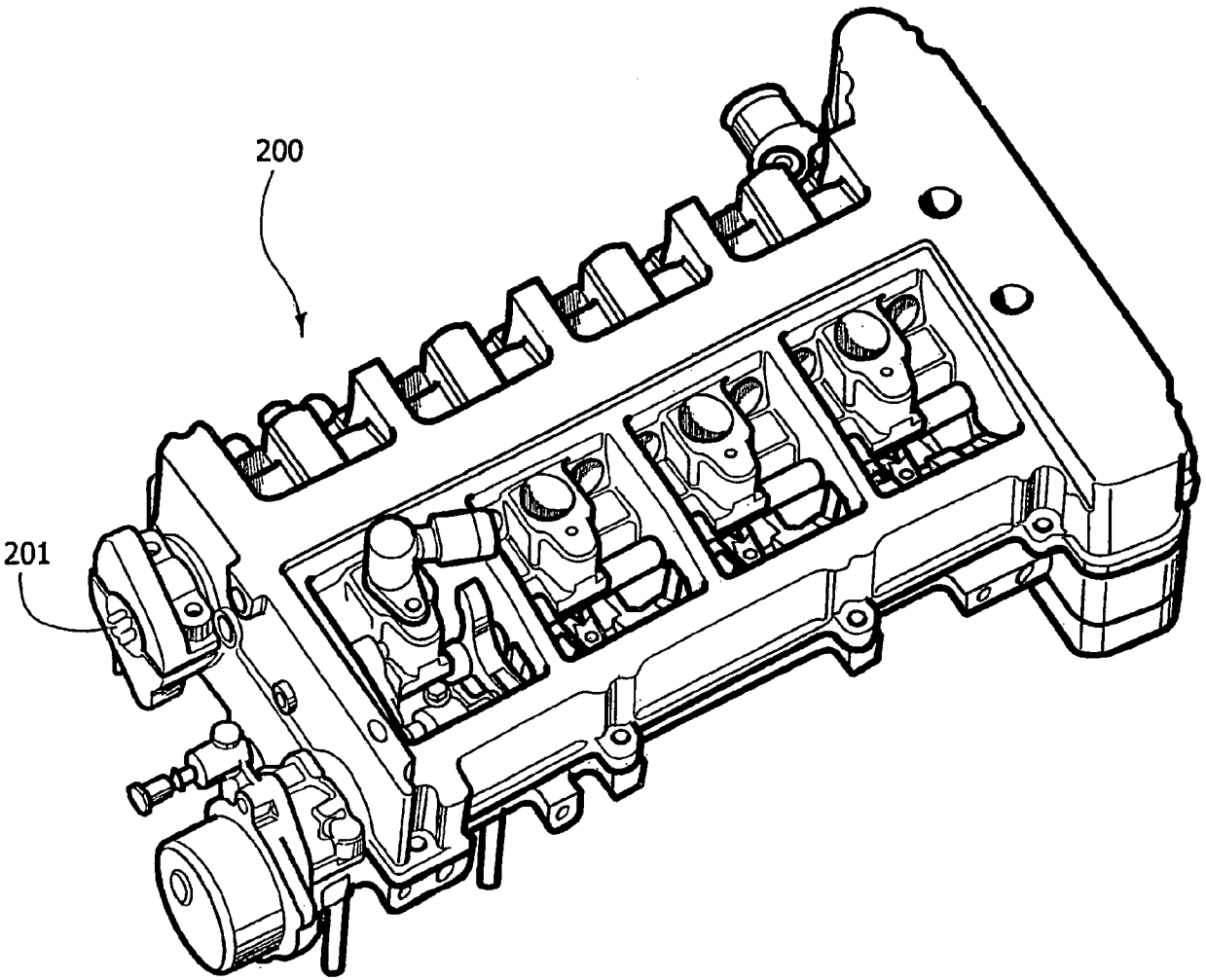
FIG. 4 is a perspective view of the assembly illustrated in FIG. 3, where for reasons of clarity the auxiliary lid that is provided thereon has been removed.

With reference to FIG. 3, all the members of the electronically controlled hydraulic device are carried by a single "brick" structure 200, which has a bottom surface, which, in the mounted condition, corresponds to the plane passing through the axes of the two shafts 11, 28. The further operation necessary for converting the conventional engine into the engine according to the invention consists in the fact that the shaft 11 becomes the only camshaft of the engine and is consequently provided with both the cams controlling the intake valves and the cams controlling the exhaust valves of the engine, whilst the shaft 28 is replaced with a shaft without cams, having one end coming out of the cylinder head that carries a power take-off 201 (FIG. 4), which is exploitable for actuation of any auxiliary system.

As in the conventional engine, the two shafts 11, 28 have ends, which are also external to the cylinder head, that carry gears 202, 203, which are designed to mesh with the gearing chain that transmits motion from the engine shaft to the shafts 11, 28.

The shaft 11, as already said, is provided both with cams for actuating the intake valves of the engine and with cams for actuating the exhaust valves. According to a solution already proposed in the prior European patent application No. 04425023.1 filed in the name of the present applicant, which is still secret at the date of filing of the present application, the cams controlling the intake valves control the latter by means of an electronically controlled hydraulic device of a type similar to what has been described with reference to FIG. 1. In FIG. 3, the parts of said device are designated by the same reference numbers that have been used in FIG. 1. Instead, the exhaust valves are controlled mechanically by the respective cams of the shaft 11. As may be seen, clearly in FIG. 3, the exhaust valves are controlled via rockers 204, each of which has one end 205 pivoted on the structure of the cylinder head, an intermediate roller for contact with the respective cam, and the opposite end 206, which controls the respective exhaust valve 70. The pumping element 16 associated to each intake valve is, instead, controlled by a rocker 207 that is pivoted on the structure of the brick 200 and has portions for engagement, respectively, with the control cam carried by the shaft 11 and with the pumping element 16.

FIG. 3 also illustrates the ignition spark plug 208 (and the corresponding coil 209) associated to the engine cylinder.

Figure 5:
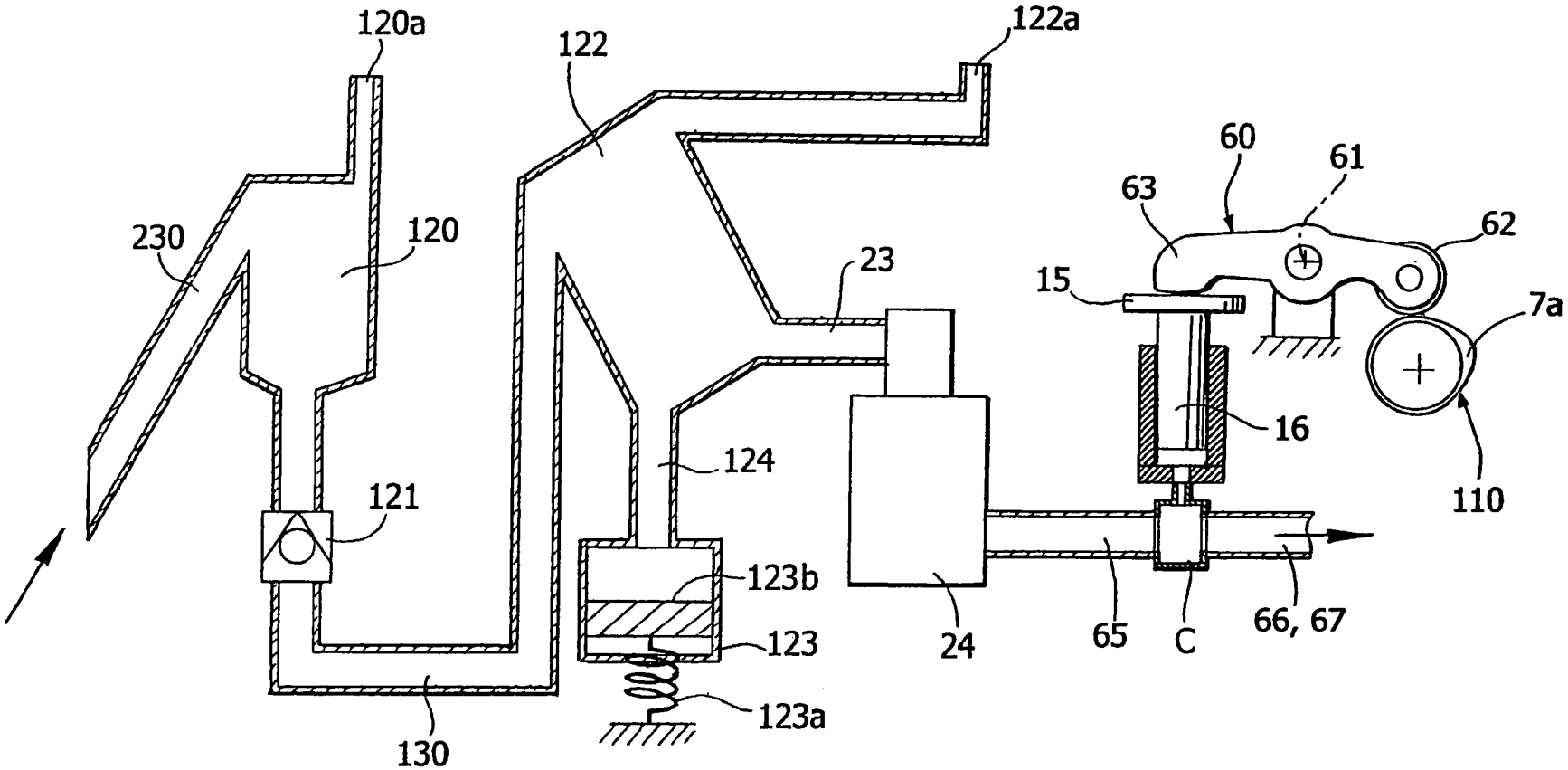
FIG. 5 is a schematic view of the hydraulic circuit of the system for variable actuation of the intake valves.

As has already been said, the "brick" carries all the elements forming part of the electronically controlled hydraulic device for variable actuation of the intake valves 7, as well as all the ports of the hydraulic system associated to said device. FIG. 5 of the annexed drawings shows, just as was proposed in the prior European patent application No. 04425023.1, a hydraulic system that envisages a breather for the air that is formed in the hydraulic device that controls the intake valves following upon a prolonged stoppage of the vehicle with the engine turned off.

At starting of the engine, the oil coming from the lubrication circuit of the engine reaches the pressure chamber C (see FIG. 10) after passing through a first supplementary tank 120, a non-return valve 121, a second supplementary tank or silo 122, communicating with an accumulator 123 and the passage 23 controlled by the solenoid valve 24. The tanks 120 and 122 have breathers 120*a* and 122*a*, respectively. It should be noted that a venting system for the air present in the device for controlling the valve has already been proposed in the prior European patent No. EP 1 243 761 B1 filed in the name of the present applicant. The system illustrated herein has, however, the novelty of providing a simple storage tank (the tank 120) set upstream of the non-return valve 121 (with reference to the direction of flow of fluid at engine starting, when the oil coming from the lubrication circuit fills the hydraulic circuit that controls the intake valves) with the arrival point of the inflow port 230 in the top part of the tank 120 and the outlet from the tank made in the bottom of the tank 120.

FIG. 5 of the annexed drawings constitutes a simplified diagram of the hydraulic circuit, which shows the way in which the air is bled off at engine starting. The oil coming from the port 230 reaches the top part of the tank 120 and is bled off through the hole 120*a* for communication with the atmosphere. In the practical embodiment, said hole 120*a* is made in a position that is remote with respect to the tank 120. The oil supplied to the tank 120 flows in the direction of a pipe 130, which branches off from the bottom of the tank 120, enabling the air contained therein to be discharged into the atmosphere. After passing through the non-return valve 121, the oil arrives in the second tank 122, where the further air possibly present therein is discharged into the atmosphere through an opening 122*a* (which, in the practical embodiment illustrated in FIGS. 7–9, is also situated in a position that is remote from the tank 122). The tank 122 is in communication, via a port 124, with a hydraulic accumulator 123, in itself of a known type, which is filled by displacing a piston 123*b* against the action of a spring 123*a*. From the bottom of the tank 122 there branches off the port 23, which can be set in communication with the pressure chamber C of the device for actuating the intake valve, via the solenoid valve 24.

As emerges clearly from the foregoing description, the engine according to the invention is distinguished from a conventional engine in that it envisages an electronically controlled hydraulic device for variable actuation of the intake valves and at the same time is distinguished also from the engines with variable actuation of the valves that have been proposed up to the present day, since it envisages two shafts in the cylinder head, one of which is a camshaft that controls both the intake valves and the exhaust valves, the other shaft being, instead, a "service" shaft, with a power take-off on the outside of the cylinder head.

Installed on the brick 200 is an auxiliary lid 300, which may be seen in FIG. 3, in which there are made blow-by passages for the oil fumes coming from the engine.

The engine according to the invention can be obtained by making relatively simple and relatively low-cost modifications, starting from the conventional engine of FIG. 2, thanks to the choice of the architecture, that has been described above.

Of course, without prejudice to the principle of the invention, the details of construction and the embodiments may vary widely with respect to what is described and illustrated herein purely by way of example, without thereby departing from the scope of the present invention.

What is claimed is:

1. An internal-combustion engine comprising an engine block defining a plurality of cylinders, and engine shaft, and a cylinder head, as well as a pair of shafts mounted rotating in the cylinder head and controlled in rotation by the engine shaft via transmission means, wherein one of said shafts mounted rotating in the cylinder head is a camshaft comprising cams for control of intake valves of the engine and cams for control of exhaust valves of the engine, wherein the cams controlling the intake valves control said intake valves by means of an electronically controlled hydraulic device for variable actuation of the intake valves, wherein the cams controlling the exhaust valves control said exhaust valves mechanically, and wherein the second shaft of said shafts mounted rotating in the cylinder head is without cams and has one end coming out of the head and constituting a power take-off, and wherein all the components of the electronically controlled hydraulic device for variable actuation of the intake valves are carried by a structure fixed on the cylinder head and having a bottom surface for resting on the cylinder head, which coincides with the plane passing through the axes of the two shafts mounted rotating in the cylinder head.

2. The engine according to claim 1, wherein the exhaust valves of the engine are controlled by the respective cams of the camshaft via exhaust valve elements co-operating with said cams on one side of said camshaft, said exhaust valve elements angularly staggered with respect to a side of said camshaft that co-operates with elements controlling the intake valves.

3. The engine according to claim 1, wherein each cylinder of the engine has at least one intake valve and at least one exhaust valve set with their axes in one and the same plane orthogonal to the axis of said single camshaft and controlled by respective cams of said single camshaft that are set at an axial distance apart from one another.

4. The engine according to claim 2, wherein said camshaft co-operates with elements controlling the exhaust valves and with elements controlling the intake valves on two sides thereof staggered with respect to one another by an angle of between 90° and 180°.

5. An internal-combustion engine comprising an engine block defining a plurality of cylinders, and engine shaft, and a cylinder head, as well as a pair of shafts mounted rotating in the cylinder head and controlled in rotation by the engine shaft via transmission means, wherein one of said shafts mounted rotating in the cylinder head is a camshaft comprising cams for control of intake valves of the engine and cams for control of exhaust valves of the engine, wherein the cams controlling the intake valves control said intake valves by means of an electronically controlled hydraulic device for variable actuation of the intake valves, wherein the cams controlling the exhaust valves control said exhaust valves mechanically, and wherein a second shaft of said shafts mounted rotating in the cylinder head is without cams and has one end coming out of the head and constituting a power take-off, and wherein said electronically controlled hydraulic device comprises hydraulic means set operatively between a tappet controlled by a cam for actuating an intake valve and said valve, said hydraulic means including a pressurized-fluid chamber, said chamber facing a pumping piston connected to the aforesaid tappet, said pressurized-fluid chamber configured to be connected by means of a solenoid valve with an exhaust port, for the purpose of disconnecting the intake valve from the respective tappet and bringing about fast closing of the valve as a result of the respective elastic return means, and electronic-control means for controlling each solenoid valve in such a way as to vary the opening time and opening stroke of the respective intake valve according to one or more operating parameters of the engine.

6. The engine according to claim 5, wherein the aforesaid hydraulic means comprise a piston for controlling each intake valve, slidably mounted so that said piston slides in a guide bushing and facing a variable-volume chamber communicating with the pressurized-fluid chamber both via first communication means, controlled by a non-return valve that enables only passage of fluid from the pressurized-fluid chamber to the variable-volume chamber, and via second communication means that enable passage between the two chambers in both directions said hydraulic means further comprising hydraulic-breaking means to bring about a restriction of said second communication means in the final step of closing of the valve of the engine.

7. The engine according to claim 6, wherein between the piston for controlling each intake valve and the stem of the intake valve there is set a hydraulic tappet.

* * * * *

UNITED STATES PATENT AND TRADEMARK OFFICE

CERTIFICATE OF CORRECTION

PATENT NO. : 7,171,932 B2
APPLICATION NO. : 11/190325
DATED : February 6, 2007
INVENTOR(S) : Vattaneo et al.

It is certified that error appears in the above-identified patent and that said Letters Patent is hereby corrected as shown below:

Claim 1

Col. 6, line 44, delete “and engine shaft,” and insert -- an engine shaft, --

Col. 6, line 59, delete “wherein the second shaft” and insert -- wherein a second shaft --

Claim 5

Col. 7, line 22, delete “and engine shaft,” and insert -- an engine shaft, --

Col. 8, line 10, after “connected” insert -- , --

Col. 8, line 11, after “valve:” insert -- , --

Claim 6

Col. 8, line 29, after “directions” insert -- , --

Signed and Sealed this

Seventeenth Day of April, 2007

JON W. DUDAS
*Director of the United States Patent and Trademark Office*